United States Patent [19]

Bouchard

[11] Patent Number: 4,929,868

[45] Date of Patent: May 29, 1990

[54] GLOW DISCHARGE LAMP CONTAINING NITROGEN

[75] Inventor: Andre C. Bouchard, Peabody, Mass.

[73] Assignee: GTE Products Corporation, Danvers, Mass.

[21] Appl. No.: 295,611

[22] Filed: Jan. 5, 1989

[51] Int. Cl.[5] ..... H01J 61/16; H01J 61/64

[52] U.S. Cl. ..... 313/619; 313/637; 313/642; 313/643

[58] Field of Search ..... 313/619, 637, 639, 642, 313/643

[56] References Cited

U.S. PATENT DOCUMENTS

| | | | |
|---|---|---|---|
| 2,067,129 | 6/1933 | Marden | 250/27.5 |
| 2,419,902 | 3/1944 | Mager | 176/122 |
| 3,559,190 | 1/1971 | Bitzer et al. | 313/583 X |
| 3,814,971 | 6/1974 | Bhattacharya | 313/643 |
| 4,000,436 | 12/1976 | Toryu et al. | 313/573 X |
| 4,408,141 | 10/1983 | Byszewski et al. | 313/306 |

OTHER PUBLICATIONS

Fluorescent Lamp Performance as Affected by Impurity Gases by Richard W. Mooney, W. Calvin Gungle; pp. 1–6, 9/1956.

A Study of the Effects of Gas Impurities in Fluorescent Lamps by Carl Kenty, Jeanette R. Cooper, (pp. 397–411), 2/1945.

*Primary Examiner*—Kenneth Wieder

*Attorney, Agent, or Firm*—Carlo S. Bessone

[57] ABSTRACT

A glow discharge lamp having increased efficiency and including a light-transmitting envelope which contains a gas fill material. A pair of electrodes is disposed in the envelope. Lead-in wires couple to the electrodes and are hermetically sealed in the envelope. The gas fill material includes at least one noble gas and a quantity of nitrogen. The nitrogen is in an amount from 1.5 percent to less than 10 percent of the total fill material.

16 Claims, 1 Drawing Sheet

GLOW DISCHARGE LAMP CONTAINING NITROGEN

CROSS-REFERENCE TO RELATED APPLICATIONS

This application discloses and claims structural features for a negative glow discharge lamp which constitutes an improvement over related subject matter disclosed and claimed in the following pending applications, each of which is assigned to the assignee of the present application:

U.S. Ser. No. 139,396 of Bouchard et al filed Dec. 30, 1987 and entitled "GLOW DISCHARGE LAMP";

U.S. Ser. No. 139,397 of Maya et al filed Dec. 30, 1987 and entitled "GLOW DISCHARGE LAMP";

U.S. Ser. No. 139,398 of Bouchard et al filed Dec. 30, 1987 and entitled "GLOW DISCHARGE LAMP";

U.S. Ser. No. 139,399 of Bouchard et al filed Dec. 30, 1987 and entitled "GLOW DISCHARGE LAMP"; and U.S. Ser. No. 191,104 of Bouchard et al filed May 6, 1988, now U.S. Pat. No. 4,836,816, and entitled "METHOD OF TREATING TUNGSTEN CATHODES".

TECHNICAL FIELD

The present invention relates in general to a compact fluorescent lamp and pertains, more particularly, to a negative glow discharge lamp which contains a predetermined amount of nitrogen.

BACKGROUND OF THE INVENTION

A negative glow lamp typically is comprised of a light transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. Examples of typical glow discharge lamps are found in U.S. Pat. No. 2,067,129 to Marden; U.S. Pat. No. 3,814,971 to Bhattacharya; and U.S. Pat. No. 4,408,141 to Byszewski et al.

As stated, the instant invention pertains to negative glow discharge lamps of the variety described above. The invention defines a glow lamp which contains a predetermined amount of an impurity (i.e., nitrogen) in the fill gas which results in an improved lamp efficacy (i.e., light output per lamp wattage).

In the past, nitrogen has been introduced into conventional fluorescent arc discharge lamps with limited success. One such lamp is described in U.S. Pat. No. 2,419,902, which issued to Mager on Apr. 29, 1947. This patent teaches the introduction into the lamp gas fill of an amount of nitrogen which is from 0.3 percent to 1.5 percent. It also teaches that quantities larger than 1 percent do not increase the efficiency greatly and do make the lamps much harder to start initially. The nitrogen improves the lumen maintenance of the lamp by 10 percent.

In a preprint of a paper presented at the National Technical Conference of the Illuminating Engineering Society in September of 1956 entitled "Fluorescent Lamp Performance as Affected by Impurity Gases", Mooney et al teach that small concentrations of nitrogen (i.e., 0.1 percent) introduced into an argon-filled F20T12 fluorescent lamp seem to be advantageous to lumen maintenance. However, a concentration of 1 percent nitrogen is shown in FIG. 2 of the reference to result in a decrease in efficiency beginning at about 750 hours. Mooney et al, like Mager, also point out that nitrogen may result in difficulties in lamp starting.

In a paper entitled "A study of the Effects of Gas Impurities in Fluorescent Lamps" which was contributed to the Symposium on Electronics, 1945, Kenty et al teach that nitrogen admitted at an end of the lamp at a constant rate of 5.7 L$\mu$/hr causes a brownish-yellow deposit which is unstable under the discharge and tends to draw together into patches.

DISCLOSURE OF THE INVENTION

It is an object of the present invention to enhance the negative glow discharge lamp art and, more particularly, to increase the efficacy of such lamps.

It is another object of the present invention to provide an improved negative glow discharge lamp which does not exhibit any deleterious effects of the starting characteristics of the lamp.

To accomplish the foregoing and other objects, features and advantages of the invention there is provided a glow discharge lamp that is comprised of a light-transmitting envelope containing a gas fill material which includes at least one noble gas and nitrogen. The nitrogen is in an amount from 1.5 percent to less than 10 percent of the total gas fill material. A pair of electrodes are disposed in the envelope and lead-in wires are associated with the electrodes for support thereof. These lead-in wires extend through and are hermetically sealed in the envelope. A power supply means is provided coupled to the electrodes via the lead-in wires and for operating the electrodes in a DC mode of lamp operation.

In accordance with further aspects of the present invention, the envelope contains mercury and emits ultraviolet radiation upon excitation. A phosphor coating is provided on an inner surface of the envelope and this emits visible light upon absorption of ultraviolet radiation. The gas fill material may comprise a mixture of neon and argon. The lamp envelope is generally of spherical construction having a maximum cross-section bulbous region with the pair of electrodes being disposed at the envelope cross-section bulbous region. The pair of electrodes are disposed in a side-by-side relationship. The cathode electrode is coated with an emissive material.

BRIEF DESCRIPTION OF THE DRAWINGS

The invention will become more readily apparent from the following exemplary description in connection with the accompanying drawing, wherein.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
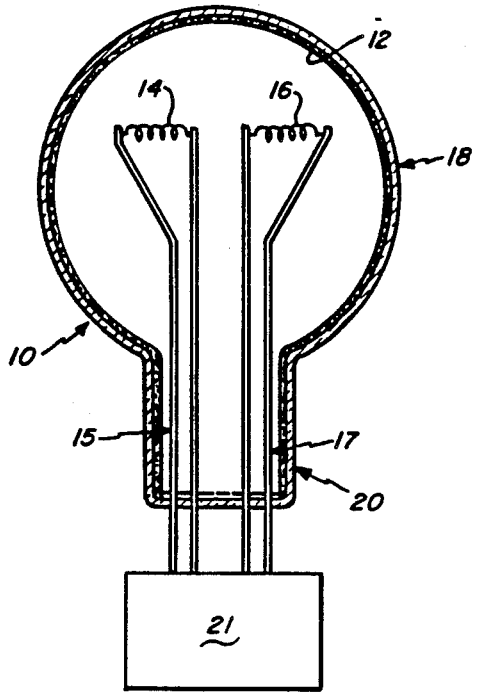
FIG. 1 is a front elevational cross-sectional view of one embodiment of a negative glow discharge lamp constructed in accordance with the principles of the present invention.

Reference is also now made herein to a co-pending Ser. No. 139,398 filed Dec. 30, 1987 on a negative glow discharge lamp employing a cathode coated with an emissive material and a bare anode. FIG. 1 herein illustrates a negative glow discharge lamp of this type including an envelope 10 that is provided with a phosphor coating as illustrated at 12. The cathode electrode 14 is coated with an emissive material such as one of barium, strontium and calcium carbonates that are converted to oxides during lamp processing. The anode electrode 16, which is typically a bare tungsten coil electrode, is uncoated. These electrodes are supported by respective lead-in wires 15 and 17. The lamp is operated in a DC mode of operation rather than an AC mode of operation. This lamp construction provides improved lumen maintenance and longer life span, particularly in comparison to prior art glow lamp constructions.

In FIG. 1 the envelope 10 is generally of spherical shape having a generally maximum cross-section bulbous region 18 and also including a neck region 20. The lead-in wires 15 and 17 are typically hermetically sealed at the neck region 20 with a wafer stem assembly. In FIG. 1, the electrodes 14 and 16 are supported primarily in a side-by-side relationship and are approximately at the maximum cross-section bulbous region 18.

Figure 2:
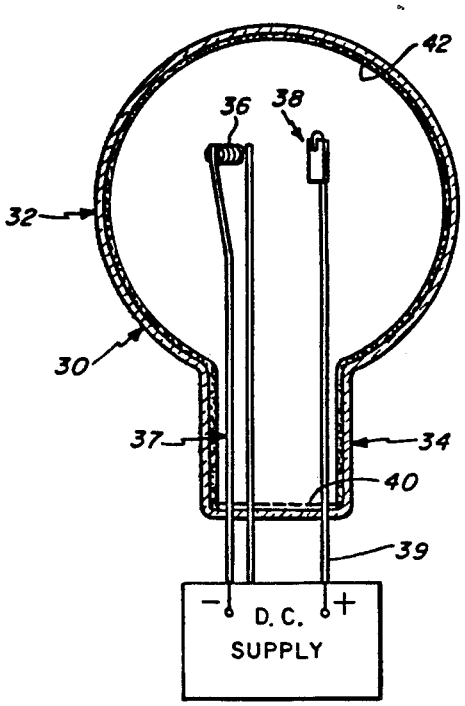
FIG. 2 is a front elevational cross-sectional view of another embodiment of a negative glow discharge lamp.

Alternatively, the glow discharge lamp may by constructed as illustrated in FIG. 2. In FIG. 2, there is illustrated the lamp envelope 30 that has a bulbous region 32 and a neck region 34. Within the envelope 30 there is disposed a cathode electrode 36 and an anode electrode 38. The cathode electrode 36 may be a standard No. 41 tungsten exciter coil. Lead-in wires 37 support the cathode electrode 36 and, as noted in FIG. 2, a single lead-in wire 39 supports the anode electrode 38. The lead-in wires may be rod-like of say 20–30 mil diameter. Both the lead-in wires 37 and a single lead-in wire 39 are hermetically sealed such as by means of a wafer stem assembly 40 that closes the bottom neck region 34 of the lamp envelope as illustrated in FIG. 2. The lead-in wires 37 are preferably also constructed of molybdenum to provide proper lamp construction and operation. The anode electrode 38 is constructed of a strip 45 of molybdenum, tungsten, or tantalum.

The foil strip 45 may be secured to the lead-in wire 39 by providing a turned end on the very end of the lead-in wire 39. This permits the end to be swagged securing the molybdenum foil strip at its very top end therebetween. In addition, one may provide a solder, adhesive or weld seal between the lead-in wire 39 and foil strip 45.

In operation, the cathode emits electrons that are accelerated so that mercury vapor is excited in the extended region of the low pressure gas. In this connection the envelope may be filled with a conventional fill material including mercury and a noble gas or mixtures of noble gases. A suitable noble gas is neon. Furthermore, the lamp can be operated from either an AC or DC power source.

In the embodiments of FIGS. 1 and 2, the envelope contains a fill material that emits ultraviolet radiation upon excitation. This fill material may comprise a noble gas or a mixture of noble gases at a fill pressure of, for example, 3 torr. The noble gases include argon, neon, helium, krypton and zenon. A quantity of mercury (e.g., 30 mg) is contained within the envelope.

It has been discovered that unlike the oftentimes questionable merits of adding nitrogen into standard arc discharge lamps, the efficacy of a negative glow discharge lamp can be substantially improved with the introduction of nitrogen into the noble fill material without exhibiting any deleterious effect on the starting characteristics of the lamp.

In accordance with the teachings of the present invention, the envelope of the negative glow discharge lamp contains a predetermined amount of nitrogen in addition to at least one noble gas. The nitrogen is in an amount greater than or equal to 1.5 percent of the fill. The amount of nitrogen should not be greater than 10 percent of the fill. Preferably, the amount of nitrogen is in an amount greater than 1.5 percent and less than 10 percent.

As typical but non-limiting examples of negative glow discharge lamps made in accordance with the teachings of the present invention, a series of lamps were constructed as illustrated in FIG. 1. Each lamp contained an anode electrode and a cathode electrode sealed in a phoshor-coated envelope. The test lamps contained 1.5, 3, 6 or 10 percent nitrogen with the balance being neon. The test lamps were compared to control lamps containing 99.5 percent neon and 0.5 percent argon. TABLE I below illustrates the light output and efficiency for each group operating on a 2.0 ampere dc circuit.

TABLE I

| FILL GAS | LUMENS | (Δ%) | LPW | (Δ%) |
|---|---|---|---|---|
| 99.5% Ne/ 0.5% Ar | 871 | — | 35.9 | — |
| 98.5% Ne/ 1.5% $N_2$ | 863 | −0.9 | 36.2 | +0.8 |
| 97% Ne/ 3% $N_2$ | 957 | +9.0 | 37.2 | +3.6 |
| 94% Ne/ 6% $N_2$ | 985 | +13.1 | 37.5 | +4.5 |
| 90% Ne/ 10% $N_2$ | 1099 | +26.2 | 32.3 | −10.0 |

TABLE I above shows the improvement in lamp efficacy and light output of negative glow discharge lamps having various amounts of nitrogen added to the fill. Three of the four lamps having 10 percent nitrogen experienced difficulties in starting. No starting difficulties were observed in the other groups. In accordance with the teachings of the present invention, a fill gas mixture having less than 10 percent nitrogen is preferred.

The reasons why the nitrogen improves the efficacy of the negative glow discharge lamp substantially more than a standard fluorescent lamp and why the starting of the glow lamp is not adversely affected by the additions of nitrogen are not clearly understood at the present time. It is speculated that the efficacy of the negative glow discharge lamp is more substantially improved with nitrogen because the wall temperature of the glow lamp operates at 100 degrees Celsius, rather than 40 degrees Celsius for a standard fluorescent lamp. This might allow more nitrogen to remain in the gas phase where it is potentially beneficial. The starting of the glow lamp is probably not adversely affected because the glow lamp does not depend on an electron avalanche to start the lamp whereas the standard fluorescent arc discharge lamp does.

While there have been shown and described what are at present considered the preferred embodiments of the invention, it will be obvious to those skilled in the art that various changes and modifications may be made therein without departing from the scope of the invention as defined by the appended claims.

What is claimed is:

1. A negative glow discharge lamp comprising:

a light transmitting envelope containing a gas fill material at a low pressure including at least one noble gas and nitrogen, said nitrogen being in an amount from 1.5 percent to less than 10 percent of the total fill material, said nitrogen being effective to increase lamp efficiency without adversely affecting the starting characteristics of said lamp, a pair of electrodes disposed in said envelope and exposed to said gas fill material, and lead-in wires coupled to the electrodes and extending through and hermetically sealed in said envelope.

2. The negative glow discharge lamp as set forth in claim 1 wherein said nitrogen is in an amount greater than 1.5 percent to less than 10 percent of said gas fill material.

3. The negative glow discharge lamp as set forth in claim 1 wherein said nitrogen is in an amount equal to about 3 percent of said gas fill material.

4. The negative glow discharge lamp as set forth in claim 3 wherein the balance of said gas fill material is neon.

5. The negative glow discharge lamp as set forth in claim 1 wherein said nitrogen is in an amount equal to about 6 percent of said gas fill material.

6. The negative glow discharge lamp as set forth in claim 5 wherein the balance of said gas fill material is neon.

7. The negative glow discharge lamp as set forth in claim 1 wherein said noble gas is neon.

8. The negative glow discharge lamp as set forth in claim 1 wherein said gas fill material comprises 98.5 percent neon and 1.5 percent nitrogen.

9. The negative glow discharge lamp as set forth in claim 1 wherein said gas fill material comprises 97.0 percent neon and 3.0 percent nitrogen.

10. The negative glow discharge lamp as set forth in claim 1 wherein said gas fill material comprises 94.0 percent neon and 6.0 percent nitrogen.

11. The negative glow discharge lamp as set forth in claim 1 wherein the envelope also contains mercury and emits ultraviolet radiation upon excitation.

12. The negative glow discharge lamp as set forth in claim 11 including a phosphor coating on an inner surface of said envelope and which emits visible light upon absorption of ultraviolet radiation.

13. The negative glow discharge lamp as set forth in claim 1 wherein the lamp envelope has a maximum cross-section bulbous region with the pair of electrodes being disposed at said envelope maximum cross-section bulbous region.

14. The negative glow discharge lamp as set forth in claim 13 wherein said pair of electrodes are disposed in a side-by-side relationship.

15. The negative glow discharge lamp as set forth in claim 1 including power supply means coupled to said electrodes via said lead-in wires for operating said pair of electrodes in a DC mode of lamp operation.

16. The negative glow discharge lamp as set forth in claim 1 wherein said one electrode is an anode electrode and the other electrode of the pair of electrodes is a cathode electrode.

* * * * *